US008961230B2

(12) United States Patent
Chou

(10) Patent No.: US 8,961,230 B2
(45) Date of Patent: Feb. 24, 2015

(54) CONNECTOR

(71) Applicant: EZCONN Corporation, Taipei (TW)

(72) Inventor: Hung-Chih Chou, New Taipei (TW)

(73) Assignee: EZCONN Corporation, Taipei (TW)

( * ) Notice: Subject to any disclaimer, the term of this patent is extended or adjusted under 35 U.S.C. 154(b) by 75 days.

(21) Appl. No.: 13/845,143

(22) Filed: Mar. 18, 2013

(65) Prior Publication Data

US 2014/0099824 A1 Apr. 10, 2014

(30) Foreign Application Priority Data

Oct. 4, 2012 (TW) ..... 101219195 U
Oct. 4, 2012 (TW) ..... 101219197 U

(51) Int. Cl.

| | |
|---|---|
| ***H01R 13/648*** | (2006.01) |
| ***H01R 12/71*** | (2011.01) |
| ***H01R 9/03*** | (2006.01) |
| ***H01R 13/627*** | (2006.01) |
| ***H01R 13/6593*** | (2011.01) |
| ***H01R 13/6594*** | (2011.01) |
| *H01R 24/60* | (2011.01) |
| *H01R 107/00* | (2006.01) |

(52) U.S. Cl.

CPC ..... *H01R 12/716* (2013.01); *H01R 9/032* (2013.01); *H01R 13/6272* (2013.01); *H01R 13/6593* (2013.01); *H01R 13/6594* (2013.01); *H01R 24/60* (2013.01); *H01R 2107/00* (2013.01); *Y10S 439/942* (2013.01)

USPC ..... 439/607.27; 439/607.48; 439/660; 439/942

(58) Field of Classification Search

USPC ..... 439/607.27, 607.48, 660, 942

See application file for complete search history.

(56) References Cited

U.S. PATENT DOCUMENTS

| | | | | |
|---|---|---|---|---|
| 6,585,528 | B1 * | 7/2003 | Lin et al. | 439/76.1 |
| 6,929,512 | B2 * | 8/2005 | Lai | 439/607.27 |
| 6,997,749 | B1 * | 2/2006 | Harubayashi | 439/607.45 |
| 7,273,397 | B2 * | 9/2007 | Watanabe et al. | 439/607.27 |
| 7,357,664 | B2 * | 4/2008 | Hsu | 439/499 |
| 7,465,183 | B2 * | 12/2008 | Hashiguchi et al. | 439/405 |
| 7,549,895 | B2 * | 6/2009 | Kondo et al. | 439/579 |
| 7,690,948 | B2 * | 4/2010 | Lung | 439/607.27 |
| 7,824,219 | B2 * | 11/2010 | Wang | 439/607.27 |
| 7,828,598 | B2 * | 11/2010 | Wang | 439/607.27 |
| 7,837,506 | B1 * | 11/2010 | Chiang et al. | 439/607.27 |
| 8,100,729 | B2 * | 1/2012 | Chen et al. | 439/719 |
| 8,591,259 | B2 * | 11/2013 | Wu | 439/607.27 |
| 8,662,927 | B2 * | 3/2014 | Yu et al. | 439/607.58 |
| 2006/0025014 | A1 * | 2/2006 | Spink | 439/607 |
| 2009/0253295 | A1 * | 10/2009 | Kameyama et al. | 439/607.27 |
| 2010/0022132 | A1 * | 1/2010 | Wang | 439/607.27 |
| 2010/0290743 | A1 * | 11/2010 | Liao et al. | 385/75 |
| 2013/0059472 | A1 * | 3/2013 | Saito | 439/607.27 |

* cited by examiner

*Primary Examiner* — Gary Paumen
(74) *Attorney, Agent, or Firm* — Min-Lee Teng; Litron Patent & Trademark Office

(57) ABSTRACT

A connecting structure comprises a board-side connector and a wire-side connector. The board-side connector comprises a frame pedestal surrounding an accommodating chamber; a metal outer shell covering the exterior of the frame pedestal; a metal inner shell mounted to a mounting hole at a rear end of the accommodating chamber; and a transmission main body mounted to an interior of the metal inner shell. The wire-side connector comprises a transmission main body having multiple terminals having multiple first ends soldered to discrete core wires of a wire cable and multiple second ends configured to contact terminals of the board-side connector; a clamp cage at a rear side of the transmission main body; and a plastic case surrounding an accommodating chamber, wherein the accommodating chamber receives second ends of the terminals.

26 Claims, 14 Drawing Sheets

CONNECTOR

RELATED APPLICATIONS

This application claims priority to Taiwan Application Serial Number 101219195, filed Oct. 4, 2012 and Taiwan Application Serial Number 101219197, filed Oct. 4, 2012, which are incorporated herein by reference in their entireties.

BACKGROUND

1. Technical Field

The invention relates to a connecting structure. More particularly, the invention relates to a board-side connector mounted onto a circuit board and a wire-side connector plugged with the board-side connector.

2. Description of Related Art

A wire-side connector is mounted to an end portion of a cable wire and configured for plugging with a corresponding board-side connector mounted to a circuit board of one electrical appliance, so as to achieve mutual transmission of electric power and signal between the cable wire and the electrical appliance.

A conventional wire-side connector primarily includes a transmission main body, and a metal shell and a plastic case that cover the exterior of the transmission main body in order. The transmission main body has a plastic frame and multiple terminals inserted to the plastic frame, and each terminal is soldered to each discrete core wire of the cable wire. The metal shell has an electric shielding function, such that an electromagnetic wave of a signal transmitted by the transmission main body is not mutually interfered with an external electromagnetic wave. A top surface of the plastic case has a buckle piece with a single supporting point, configured for buckling with a buckle hole configured at a corresponding position of the board-side connector. When used, the wire-side connector is plugged into the interior of the board-side connector, and the transmission of the signals and the electric power between the two connectors is achieved through the contact between the transmission bodies configured in the two connectors, and a plugging relation between the two connectors is maintained as the buckle piece with the single supporting point configured in the wire-side connector is buckled to the buckle hole of the board-side connector.

However, the above-described conventional wire-side connector has the following disadvantages in structure: (1) the buckle piece of the above-described conventional wire-side connector is the buckle piece with a single supporting point, which means that one end of the buckle piece is connected to the top surface of the plastic case, and the other end of the buckle piece is suspended, the structural strength of this type of the buckle piece with the single supporting point is fragile and easy to be damaged, and a bonding strength between the buckle piece with the single supporting point and the buckle hole of the board-side connector is also weak; (2) for each discrete core wire between the end portion of the cable wire and the transmission main body, no object is configured to carry and fix these discrete core wires, and geometry, relative distance, position and dimension of each discrete core wire are presented in an unstable state as the buckle piece with the single supporting point is suspended, which affects the stability of signal transmission; (3) an accommodating space of the plastic case is fixed and only cable wires with a single wire diameter can be received therein, which limits select and use of cable wires with different wire diameters; and (4) the entire plastic case is a plastic injection molded member made of the same material, and for convenience of plugging with the board-side connector, the plastic case is usually a rigid plastic case, which means a plugging end (for plugging with the board-side connector) and a cable wire jointing end (for fixing the end portion of the cable wire) respectively located at two ends of the plastic case both are rigid plastic materials, while the rigid cable wire jointing end will limit a winding curvature of the cable wire, which relatively increases the space occupied by the cable wire and the wire-side connector thereof.

The board-side connector is mounted onto a circuit board of an electrical appliance and configured for plugging with a corresponding wire-side connector mounted to a cable wire, so as to mutually transmit the electric power and signals between the cable wire and the electrical appliance.

A conventional board-side connector primarily includes a transmission main body and a metal outer shell covering the exterior of the transmission main body. The transmission main body has a plastic pedestal and multiple terminals inserted to the plastic pedestal. The transmission main body has a elastic contacting arm contacted with an inner wall of the metal outer shell for grounding. The metal outer shell has an electric shielding function, such that an electromagnetic wave of a signal transmitted by the transmission main body is not mutually interfered with an external electromagnetic wave. The metal outer shell has multiple welding feet, which are mechanically welded and fixed to fixing holes on the circuit board. The multiple terminals of the transmission main body are electrically welded to multiple circuit through holes configured in the circuit board, so as to achieve an electrical connection between the transmission main body and the circuit board lines.

However, the above-described conventional board-side connector has the following disadvantages in structure: (1) the conventional board-side connector only has the metal outer shell as a single layer of electric shielding structure, and a shielding effect for the external electromagnetic wave is not perfect; (2) the elastic contacting arm of the conventional board-side connector is contacted with the metal outer shell at a single position, and the number of contact points thereof is small and an impedance cannot be reduced effectively, so that an electric shielding effect of the metal outer shell is affected; (3) the multiple welding feet of the metal outer shell are welded to the circuit board in a single shaft flat direction, and the single shaft welding cannot provide a strong bonding force between the metal outer shell and the circuit board, which is not sufficient for resisting pulling, pushing and twisting forces when the wire-side connector is plugged into or out from the board-side connector, so that stability of an electrical contact between two connectors is affected.

The applicability of the conventional board-side connector and the conventional wire-side connector are poor due to the above reasons.

SUMMARY

The invention is directed to provide a wire-side connector having a solid buckle structure.

The invention is further directed to provide a wire-side connector, which can keep geometry, a relative distance and position, and a dimension of each discrete core wire of a cable wire in a stable state, so as to enhance the stability of signal transmission.

The invention is also directed to provide a wire-side connector, which can receive cable wires with different wire diameters, so as to enhance selecting flexibility for the cable wires with different wire diameters.

The invention is also directed to provide a wire-side connector, which can increase a winding curvature of a cable wire, save space, and enhance the convenience for use.

According to one of the purposes described above, an aspect of the invention provides a wire-side connector, which is mounted to an end portion of a cable wire and configured for plugging with a board-side connector, wherein the cable wire has multiple discrete core wires, and each discrete core wire has a rear section, a middle section and a front section in order from an inner end to an outer end of the cable wire; the wire-side connector including a transmission main body having a plastic frame and multiple terminals inserted to the plastic frame, wherein each terminal has a docking end and a wiring end, which are respectively protruded at a front end and a rear end of the plastic frame, and each wiring end is soldered to the front section of each discrete core wire; a clamp cage having multiple clamp slots, each of which clamps the middle section of each discrete core wire; a metal bottom shell fixed to the plastic frame of the transmission main body and carried at bottom surfaces of the transmission main body, the clamp cage and each discrete core wire, wherein a top surface of the metal bottom shell has a cover body and an opening, and the cover body covers the top surface of the transmission main body; a metal top shell covering the opening, and the metal top shell has a fixing ring, which clamps a periphery of the end portion of the cable wire; an external mold compound enclosing the periphery of the end portion of the cable wire and the fixing ring by a molding process; and a plastic case secured to the external mold compound, wherein the plastic case has a frame body surrounding an accommodating chamber, and the metal bottom shell, the metal top shell and the external mold compound are received in the accommodating chamber, and the top surface of the frame body is configured with a thin sheet with double supporting points, which means that both ends of the thin sheet are fixed with the top surface of the frame body, a gap exists between the middle of the thin sheet and the top surface of the frame body, and the top surface of the thin sheet has a buckle body. The thin sheet with the double supporting points and the buckle body can strengthen the mechanical strength of these members, and provide a stable buckling force; and furthermore, a configuration of the clamp cage can keep a geometry, a relative distance and position, and a dimension of each discrete core wire of the cable wire in a stable state.

According to an embodiment of the invention, the front end of the buckle body is formed as an inclined wall, and the rear end of the buckle body is formed as a vertical retaining wall. The inclined wall of the buckle body is used for guiding the buckle body to be smoothly buckled to the buckle hole of the board-side connector; and the vertical retaining wall of the buckle body is used for abutting against the inner wall of the buckle hole after the buckle body is buckled and positioned, so as to prevent loose between the buckle body and the buckle hole.

According to an embodiment of the invention, the top surface of the thin sheet is configured with a press protrusion body at a rear position of the buckle body, which is used for pushing down and then pulling out the buckle body.

According to an embodiment of the invention, a concave-down part is formed at the bottom surface of the rear end portion of the accommodating chamber. Accordingly, partial heights of the external mold compound and a first internal mold compound can be extended for receiving cable wires with different wire diameters, so as to enhance the selecting flexibility for the cable wires with different wire diameters.

According to an embodiment of the invention, the wire-side connector further includes a first internal mold compound, which encloses the rear section of each discrete core wire by a molding process. Accordingly, the geometry, the relative distance and position, and the dimension of each discrete core wire are solidified and fixed at the front section of each discrete core wire.

According to an embodiment of the invention, the wire-side connector further includes a second internal mold compound, which encloses the front section of each discrete core wire and the wiring end of each terminal by a molding process. Accordingly, the geometry, the relative distance and position, and the dimension of each discrete core wire are solidified and fixed again at the rear section of each discrete core wire.

According to an embodiment of the invention, each of two opposite sidewalls of the metal bottom shell is configured with a first buckle hole, and each of two opposite sidewalls of the plastic frame of the transmission main body is configured with a first buckle body, which is buckled to the first buckle hole. As such, the metal bottom shell and the transmission main body are fixed with each other, and the metal bottom shell covers the exterior of the plastic frame of the transmission main body.

According to an embodiment of the invention, each of two opposite sidewalls of the metal top shell is configured with a second buckle hole, and each of two opposite sidewalls of the metal bottom shell is configured with a second buckle body, which is buckled to the second buckle hole. As such, the metal top shell and the metal bottom shell are fixed with each other, and the metal top shell covers the top surfaces of the clamp cage, the first internal mold compound and the second internal mold compound.

According to an embodiment of the invention, each of two opposite sidewalls of the plastic case each is configured with a third buckle hole, and each of two opposite sidewalls of the external mold compound is configured with a third buckle body, which is buckled to the third buckle hole. As such, the plastic case and the external mold compound are fixed with each other.

According to an embodiment of the invention, the external mold compound is a soft external mold compound, and the plastic case is a hard plastic case. Accordingly, the external mold compound as an elastic body can absorb an external force generated by bending and twisting of the cable wire, such that the cable wire can be winded adjacent to the wire-side connector, so as to increase the winding curvature of the cable wire and save the mounting space thereof.

The invention is directed to provide a board-side connector having a double electric shielding effect.

The invention is further directed to provide a board-side connector, which can enhance an electric shielding effect.

The invention is also directed to provide a board-side connector, which can be bonded tightly with a circuit board.

According to one of the above-described purposes, an aspect of the invention provides a board-side connector for plugging with a wire-side connector. The board-side connector includes a plastic frame pedestal having a frame body surrounding an accommodating chamber, wherein an opening and a mounting hole are provided respectively at a front end and a rear end of the accommodating chamber; a metal outer shell covering the exterior of the plastic frame pedestal, wherein the metal outer shell has at least one first welding foot at the bottom of each opposite side of the metal outer shell; a metal inner shell mounted to the mounting hole of the plastic frame pedestal and protruding into the accommodating chamber, wherein the metal inner shell has at least one elastic contacting arm at a top of a rear end of the metal inner shell and at least one second welding foot at two opposite sides of the rear end of the metal inner shell, and the elastic contacting arm contacts a top inner wall of the metal outer shell; and a transmission main body mounted to the interior of the metal inner shell, wherein the transmission main body has a plastic frame and multiple terminals inserted to the plastic frame and protruded from the rear end of the plastic frame, and the terminals each have a downward-bent outer part. Double electric shielding effects are generated because the transmission main body is shielded by the metal inner shell and the metal outer shell of the board-side connector such that the external electromagnetic wave can be effectively shielded.

According to an embodiment of the invention, the board-side connector further includes a retainer, wherein the retainer is located at the rear end of the plastic frame pedestal and contained in the interior of the metal outer shell and configured with inserting holes, positions and quantity of the inserting holes correspond to the terminals, and an outer end portion of each terminal passes through the inserting holes and is bent downward. Each terminal is retained at a stable position according to the retainer.

According to an embodiment of the invention, the elastic contacting arm is configured with a cutting groove along a longitudinal direction thereof, so as to divide the elastic contacting arm into a first side elastic contacting arm and a second side elastic contacting arm. The quantity of contact points between the metal inner shell and the metal outer shell is increased accordingly, so as to reduce the impedance and increase the electric shielding effect.

According to an embodiment of the invention, the first welding foot is a flat vertical direction welding foot, and the second welding foot is a flat lateral direction welding foot perpendicular to the flat vertical direction welding foot. Through the welding feet perpendicular to each other, a very strong welding fastness is provided between the board-side connector and the circuit board.

According to an embodiment of the invention, each of two opposite sidewalls of the plastic frame pedestal is configured with a first buckle slot, and each of two opposite sidewalls of the metal outer shell is with a first buckle sheet, which is buckled to the first buckle slot. The assembly of the metal outer shell and the plastic frame pedestal is achieved accordingly.

According to an embodiment of the invention, each of two opposite sidewalls of the plastic frame of the transmission main body is configured with a second buckle slot, and each of two opposite sidewalls of the metal inner shell is configured with a second buckle sheet, which is buckled to the second buckle slot. The assembly of the transmission main body and the metal inner shell is achieved accordingly.

According an embodiment of the invention, a positioning hole is configured at a front end of a top wall of the plastic frame pedestal for buckling and positioning when the board-side connector is plugged into the wire-side connector.

BRIEF DESCRIPTION OF THE DRAWINGS

In order to make the foregoing as well as other aspects, features, advantages and embodiments of the invention more apparent, the accompanying drawings are described as follows.

DETAILED DESCRIPTION

Figure 1:
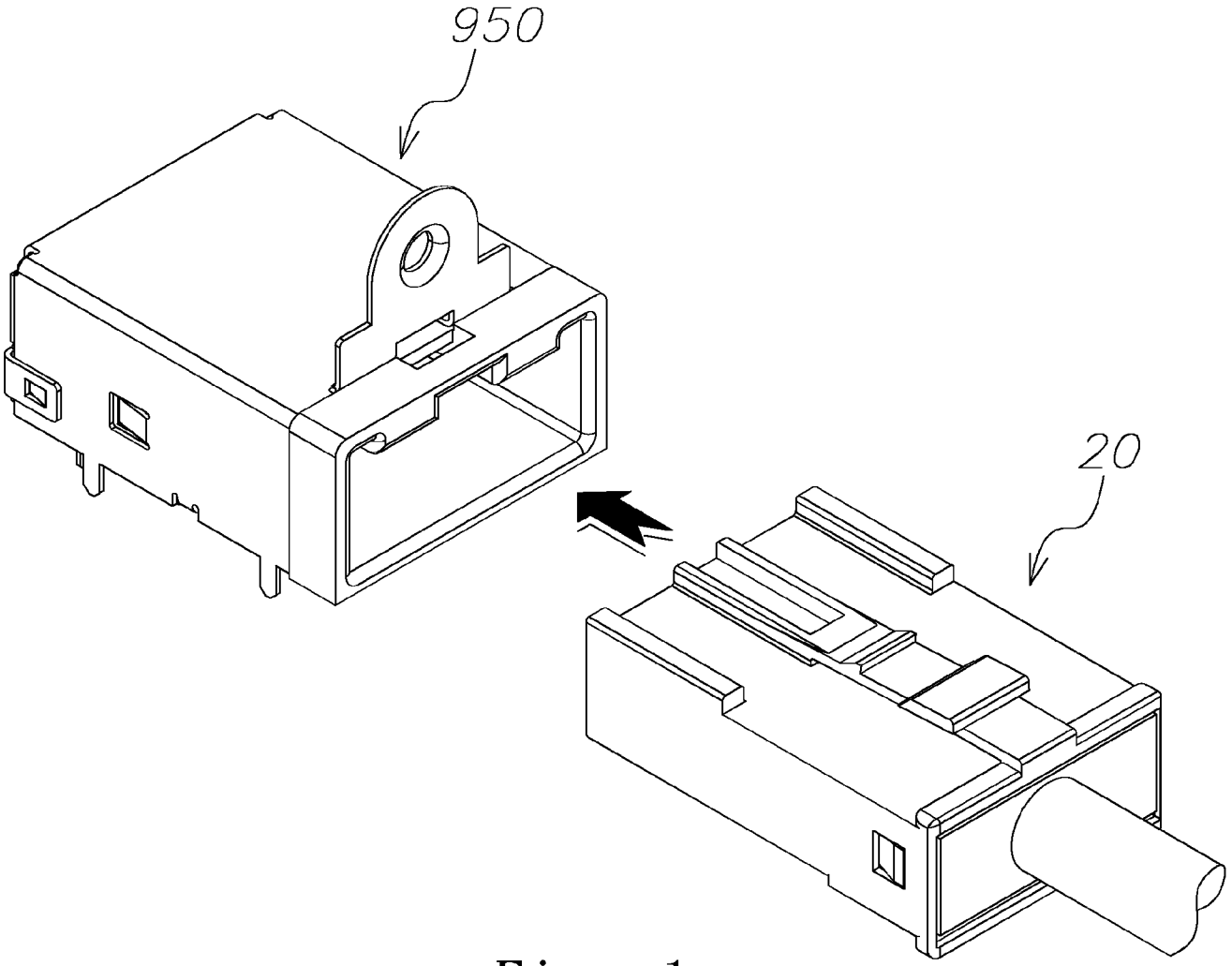
FIG. 1 is a perspective view depicting a wire-side connector and a board-side connector according to an embodiment of the invention.
Figure 2:
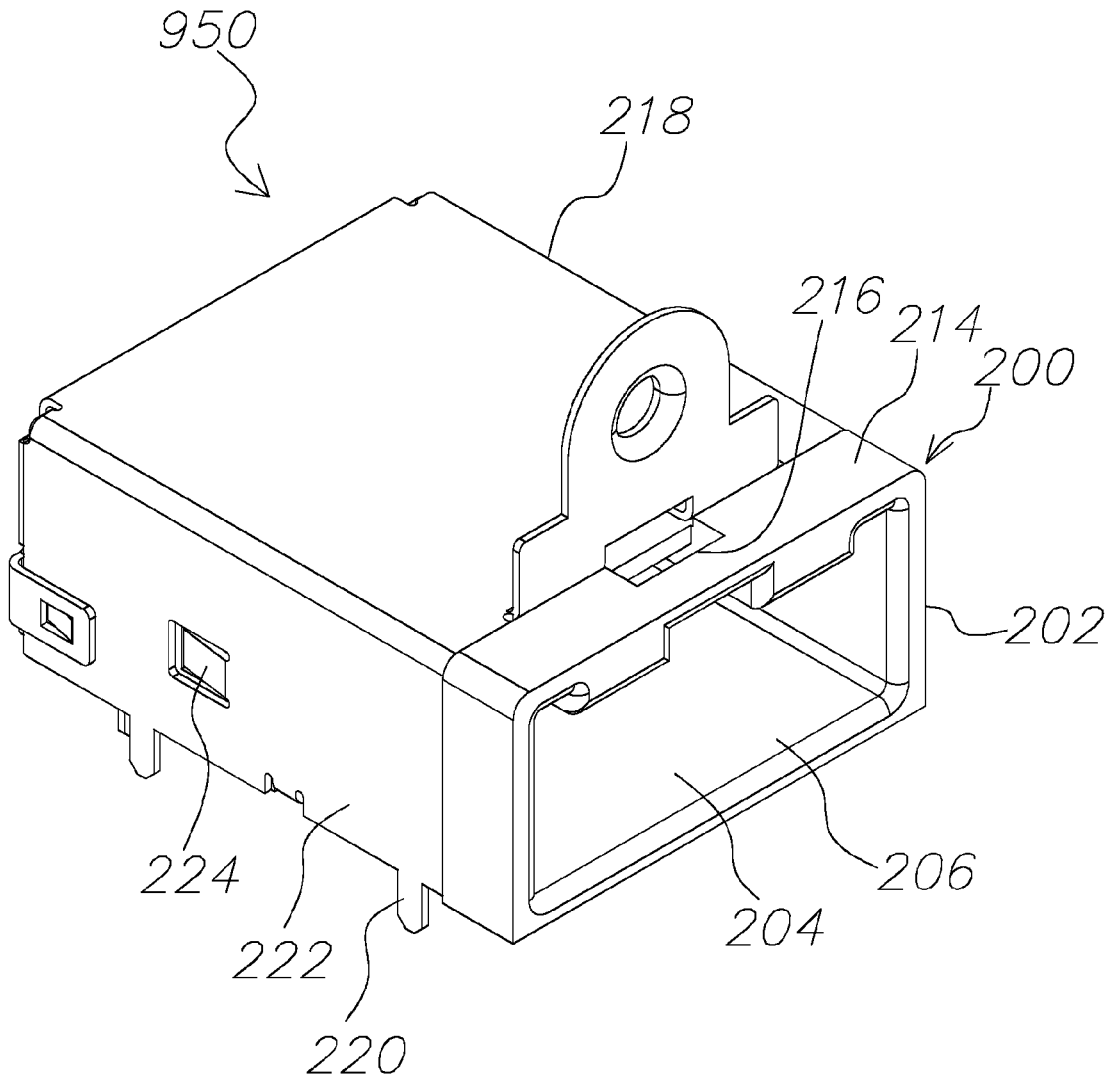
FIG. 2 depicts a top perspective view of a board-side connector according to an embodiment of the invention viewed from a former top direction thereof.
Figure 3:
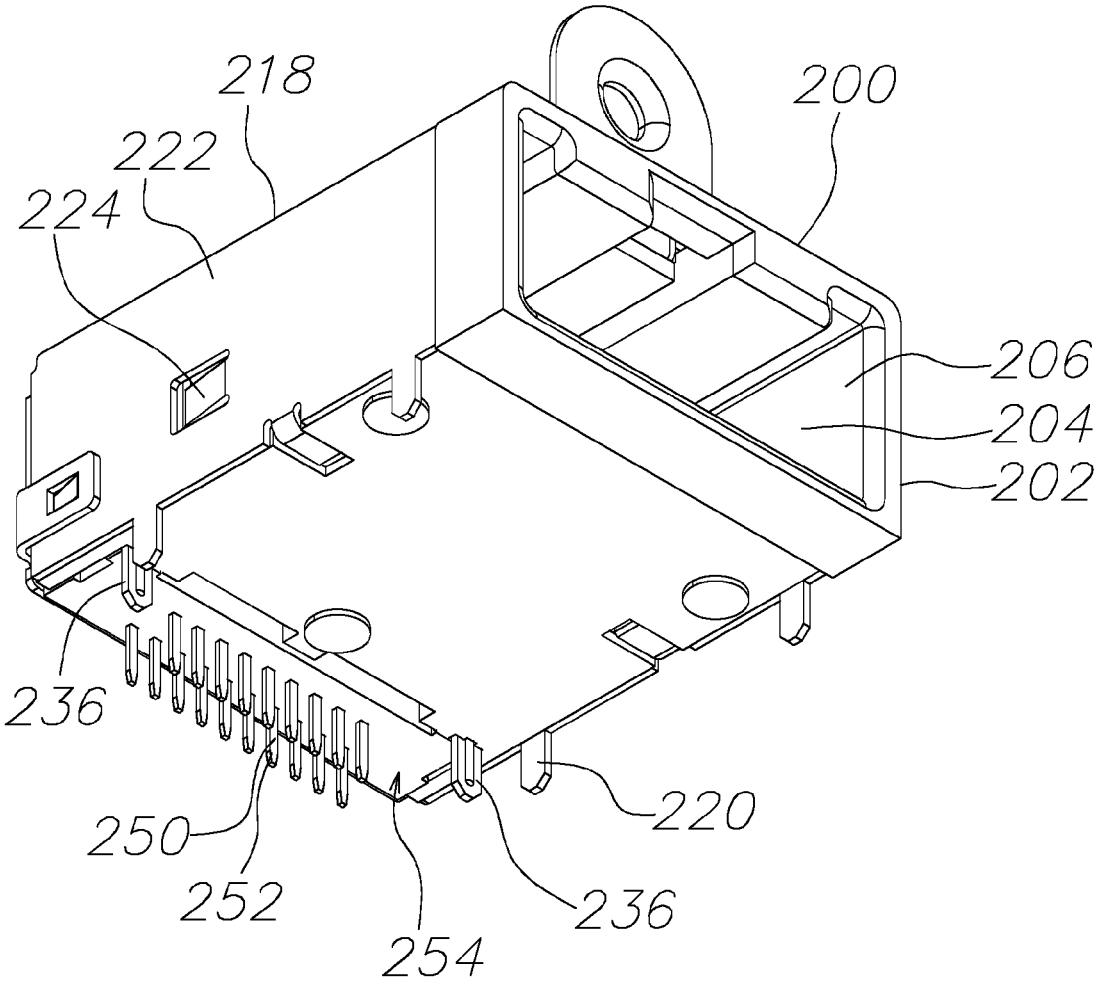
FIG. 3 depicts a bottom perspective view of a board-side connector according to an embodiment of the invention viewed from a former bottom direction.
Figure 4:
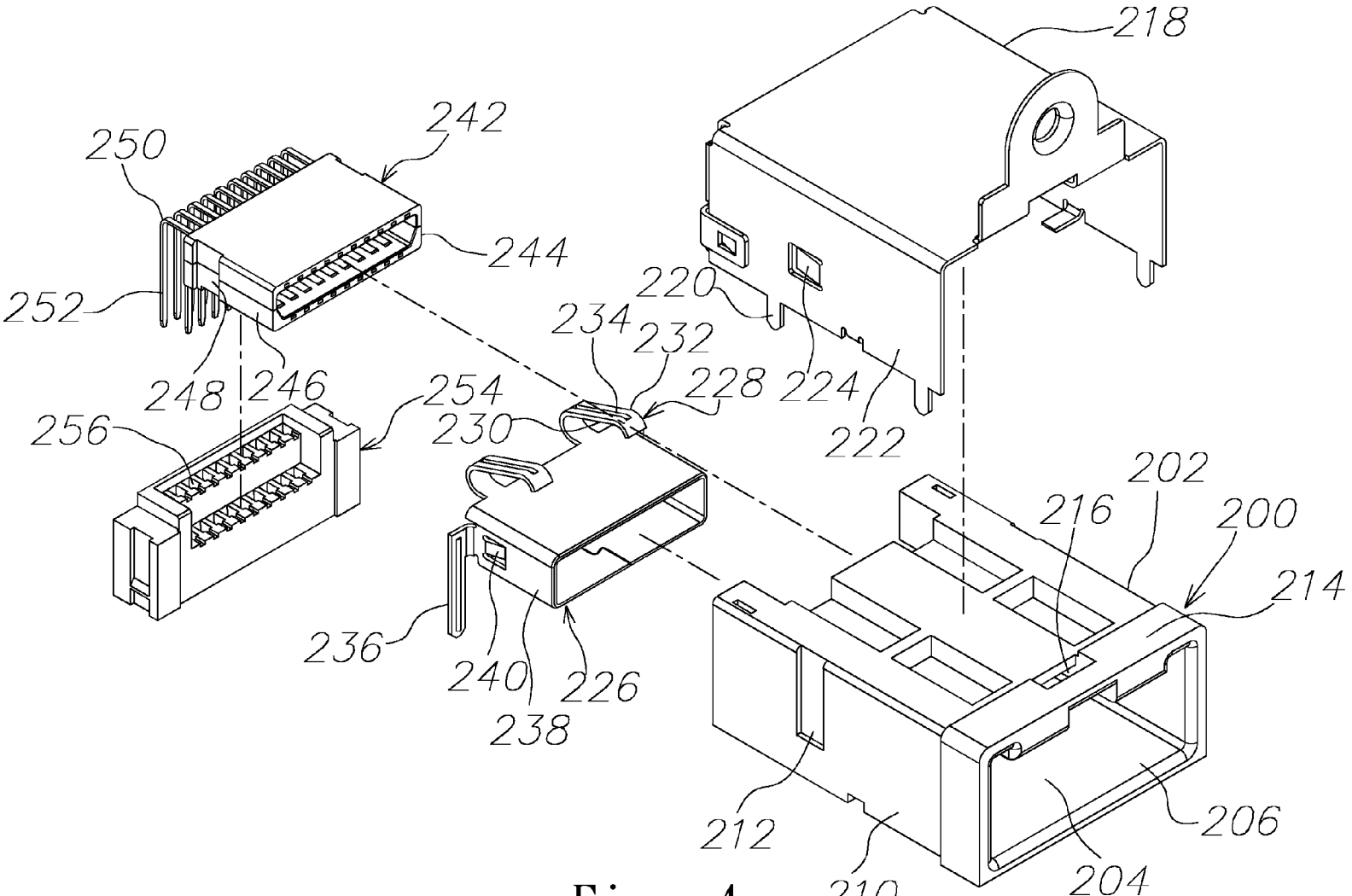
FIG. 4 depicts an exploded view of the board-side connector shown in FIG. 2.

Referring to FIG. 1, the invention discloses to a connecting structure, wherein the connecting structure comprises a board-side connector 950 and a wire-side connector 20 plugged with the board-side connector 950. The foregoing and other technical contents, features and functions of the invention will be clearly presented in the following detailed description of the embodiments with reference to the accompanying drawings.

Board-side Connector

Referring to FIGS. 2 to 6, two perspective views, an exploded view, a sectional view and a schematic mounting view of the board-side connector 950 according to an embodiment of the invention are illustrated. As shown by the drawings, the board-side connector 950 according to an embodiment of the invention includes a plastic frame pedestal 200, a metal outer shell 218, a metal inner shell 226, a transmission main body 242 and a retainer 254.

The transmission main body 242 has a plastic frame 244 and multiple terminals 250 inserted to the plastic frame and protruded outside the rear end of the plastic frame. Each of the terminals has a downward-bent outer part 252 for electrically welding to circuit through holes 260, and positions and numbers thereof correspond to the circuit through holes 260 of the circuit board 258. The transmission main body 242 is used for inserting with a corresponding male-terminal transmission main body of the wire-side connector 20 for a circuit transmission of the signal and electric power.

The transmission main body 242 is mounted to the interior of the metal inner shell 226. For the transmission main body 242, the metal inner shell 226 has a first electric shielding effect; and that is, the metal inner shell 226 can be used for insulating the electromagnetic wave of the circuit of the transmission main body 242 from mutually interfering with the electromagnetic wave outside the electric shield.

In an embodiment of the combination of the transmission main body 242 and the metal inner shell 226, each of two opposite sidewalls 246 of the plastic frame 244 of the transmission main body 242 is configured with a second buckle slot 248, and each of two opposite sidewalls 238 of the metal inner shell 226 is configured with a second buckle sheet 240, which is buckled to the second buckle slot 248 of the transmission main body 242. The combination of the metal inner shell 226 and the transmission main body 242 is achieved accordingly, and the metal inner shell 226 covers the exterior of the plastic frame 244 of the transmission main body 242.

The plastic frame pedestal 200 has a frame body 202 surrounding an accommodating chamber 204. An opening 206 and a mounting hole 208 are respectively provided at the front end and the rear end of the accommodating chamber 204. The opening 206 is used for receiving a main body of the wire-side connector 20 in the accommodating chamber 204 accordingly. The mounting hole 208 is used for mounting the following metal inner shell 226 and the transmission main body 242. The plastic frame pedestal 200 is used for insulation of the exterior of the transmission main body 242. Additionally, a positioning hole 216 is configured at the front end of a top wall 214 of the plastic frame pedestal 200. When the wire-side connector 20 is plugged into the board-side connector 950 of the invention, the positioning hole 216 is used for buckling and positioning the buckle body configured in the wire-side connector 20.

The metal outer shell 226 covers the exterior of the plastic frame pedestal 200, as a second electric shield of the transmission main body 242, so as to insulate the electromagnetic wave of the circuit of the transmission main body 242 from mutually interfering with the electromagnetic wave outside the electric shield again accordingly. Therefore, the board-side connector 950 according to an embodiment of the invention has multiple-layered electric shielding to ensure that the signal and electric power transmitted through the transmission main body 242 is not interfered by an external electromagnetic wave. For example, the board-side connector 950 has two-layered electric shielding in the embodiment.

In an embodiment of the combination of the metal outer shell 218 and the plastic frame pedestal 200, each of two opposite sidewalls 210 of the plastic frame pedestal 200 is configured with a first buckle slot 212, and each of two opposite sidewalls 222 of the metal outer shell 218 is configured with a first buckle sheet 224, which is buckled to the first buckle slot 212 of the plastic frame pedestal 200. The combination of the metal outer shell 218 and the plastic frame pedestal 200 is achieved accordingly, and the metal outer shell 218 covers the exterior of the plastic frame pedestal 200.

Additionally, two first welding feet 220 are provided at the bottoms of each sides of the metal outer shell 218 for mechanically welding and fixing to a first fixing hole 262 configured at the corresponding position of the circuit board 258. In one embodiment, the first welding foot 220 is a flat longitudinal welding foot flatly extending in a longitudinal direction that is the same as a plugging direction of the wire-side connector 20.

The metal inner shell 226 and the transmission main body 242 inside the metal inner shell 226 are mounted to the mounting hole 208 of the plastic frame pedestal 200 and protruded toward the accommodating chamber 204. Two elastic contacting arms 228 are provided at the top of the rear end of the metal inner shell 226, which contact a top inner wall of the metal outer shell 218. Each of the elastic contacting arms 228 is configured with a cutting groove 234 along the longitudinal direction thereof, so as to divide each elastic contacting arm 228 into a first side elastic contacting arm 230 and a second side elastic contacting arm 232 respectively. Accordingly, when the elastic contacting arm 228 of the metal inner shell 226 is compressed under stress in the interior of the metal outer shell 226, double contact points are formed between the metal inner shell 226 and the metal outer shell 218 for electric shielding, so as to reduce the impedance and increase the electric shielding effect.

Additionally, two second welding feet 236 are provided at opposite sides of the rear end of the metal inner shell 226 for mechanically welding and fixing to a second fixing hole 264 configured at the corresponding position of the circuit board 258. In one embodiment, the second welding foot 236 is a flat lateral foot flatly extending in a lateral direction perpendicular to the plugging direction of the wire-side connector 20. That is, the second welding foot 236 in the flat lateral direction and the first welding foot 210 in the flat vertical direction are perpendicular to each other. When the two welding feet perpendicular to each other are respectively welded and fixed to the circuit board 258, the welding fastness between the whole board-side connector 950 and the circuit board can be achieved. The fastness can resist pulling, pushing and twisting forces when the wire-side connector 20 is plugged to the board-side connector 950, and in addition to the stable structure thereof, a fine quality is retained for the electric contact between the two connectors.

The retainer 254 is located at the rear end of the plastic frame pedestal 200 and contained in the interior of the metal outer shell 218 and configured with inserting holes 256 having the positions and quantity corresponding to each terminal 250 of the transmission main body 242, and an outer part 252 of each terminal 250 is bent downward after passing through the inserting holes 256. Each terminal 250 can be retained at a stable position through the retainer 254.

For the transmission main body, the board-side connector 950 according to an embodiment of the invention has the double electric shielding effect by the means of the metal inner shell and the metal outer shell thereof, and thus the external electromagnetic wave can be shielded effectively. Furthermore, the double numbers of contact points are formed in the local area that the metal inner shell is mutually contacted with the metal outer shell to reduce the impedance, so as to increase the electric shielding effect; moreover, the metal inner shell and the metal outer shell are welded and fixed to the circuit board respectively through the second welding foot and the first welding foot perpendicular to each other, wherein after the welding feet perpendicular to each other are welded and fixed to the circuit board, a very strong welding fastness is provided, and any operating force generated by plugging with or from the wire-side connector 20 can be resisted to retain the fine quality of the electric contact between the two connectors. The above descriptions actually reach the creative purposes of the invention.

Wire-side Connector

Referring to FIGS. 7 to 18, a perspective view, an exploded view, a sectional view, a side view, a schematic operation view and a schematic assembly view of each member of the wire-side connector 20 according to an embodiment of the invention are illustrated. As shown in these drawings, the wire-side connector 20 according to an embodiment of the invention is mounted to an end portion 910 of a cable wire 900 and is configured for plugging with the board-side connector 950. The cable wire 900 has multiple discrete core wires 920. Each discrete core wire has a rear section 921, a middle section 922 and a front section 923 in order from the inner end to the outer end of the cable wire 900. An insulating coating has been stripped from the front section 923 to expose a bare wire of the front section 923.

The wire-side connector 20 according to an embodiment of the invention includes a transmission main body 100, a clamp cage 140, a first internal mold compound 300, a second internal mold compound 400, a metal bottom shell 500, a metal top shell 600, an external mold compound 700 and a plastic case 800.

Figure 13:
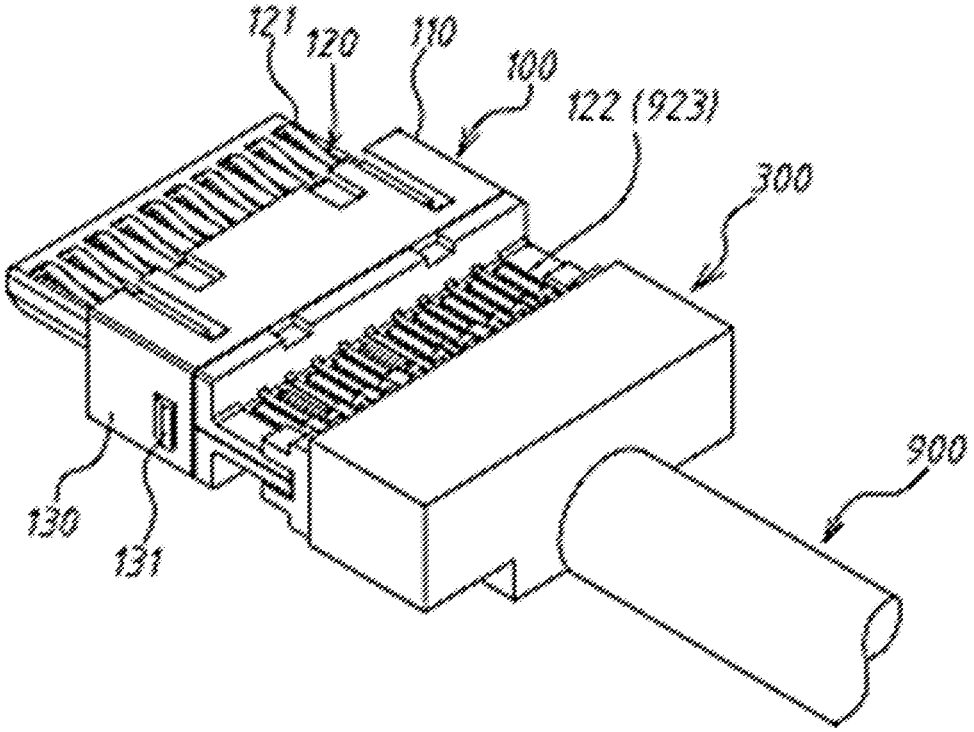
FIG. 13 depicts a schematic assembly view of assembling a transmission main body to the wire-side connector under the structure shown in FIG. 12.
Figure 14:
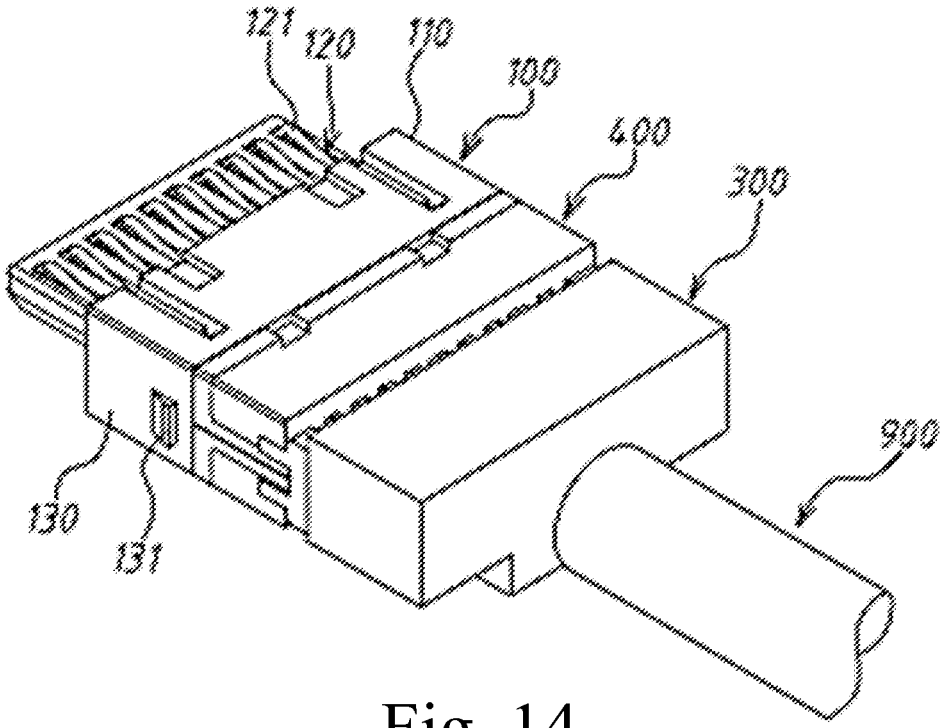
FIG. 14 depicts a schematic assembly view of assembling a second internal mold compound to the wire-side connector under the structure shown in FIG. 13.

Referring to FIG. 13, the transmission main body 100 has a plastic frame 110 and multiple terminals 120 inserted to the plastic frame. Each terminal has a docking end 121 and a wiring end 122, which are protruded from the front end and rear end of the plastic frame 110 respectively, and each wiring end 122 is soldered to the front section 923 of each discrete core wire 920, so as to achieve an electrical connection. When used, the transmission main body 100 is plugged into the board-side connector 950, and the docking end 121 of the terminal 120 is electrically contacted with a corresponding male-terminal transmission main body (not shown) of the board-side connector 950 for a loop transmission of the signal and electric power.

Figure 12:
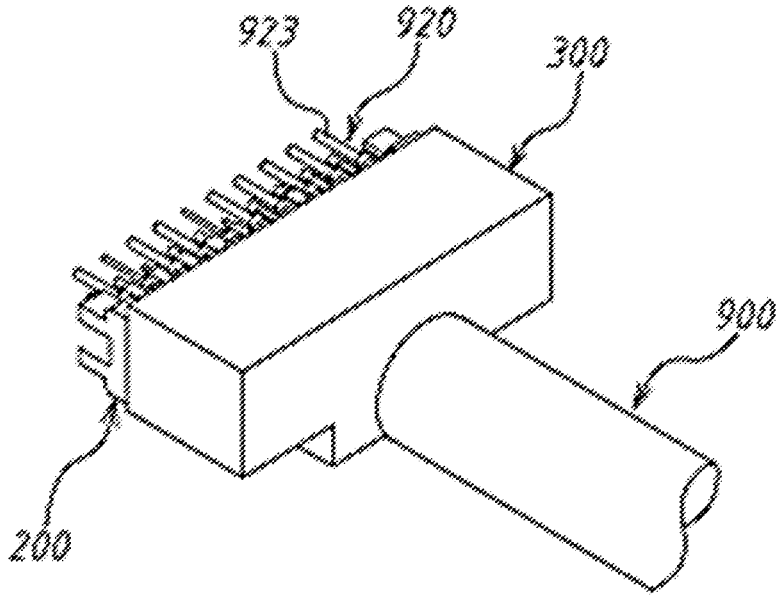
FIG. 12 depicts a schematic assembly view of a clamp cage, a first internal mold compound and a cable wire in the wire-side connector shown in FIG. 8.

Referring to FIGS. 12 and 13, the clamp cage 140 has multiple clamp slots 142, each of which clamps the middle section 922 of each discrete core wire 920 of the cable wire 900. The clamp cage 140 is designed as a movable type, and assisted with a proper tensile clamp and a positioning fixture (both are not shown), such that each discrete core wire 920 can have an equivalent stretch force due to the move of the clamp cage 140, and the geometry, the relative distance and position, and the dimension of each discrete core wire 920 is kept under an expected design; and moreover, the discrete core wires 920 bear substantially the same stretch so as to achieve the maximum bonding force between the discrete core wires 920 and the terminals 120 of the above-described transmission main body 100, and avoid the situation that the discrete core wires 920 lose signals when the cable wire 900 is under stress; when the following internal mold compound is injected to cover each discrete core wire 920, the equivalent stretch force can also avoid the twist and deformation of each discrete core wire 920 created by the injection force so as to avoid breaking of impedance match.

Figure 8:
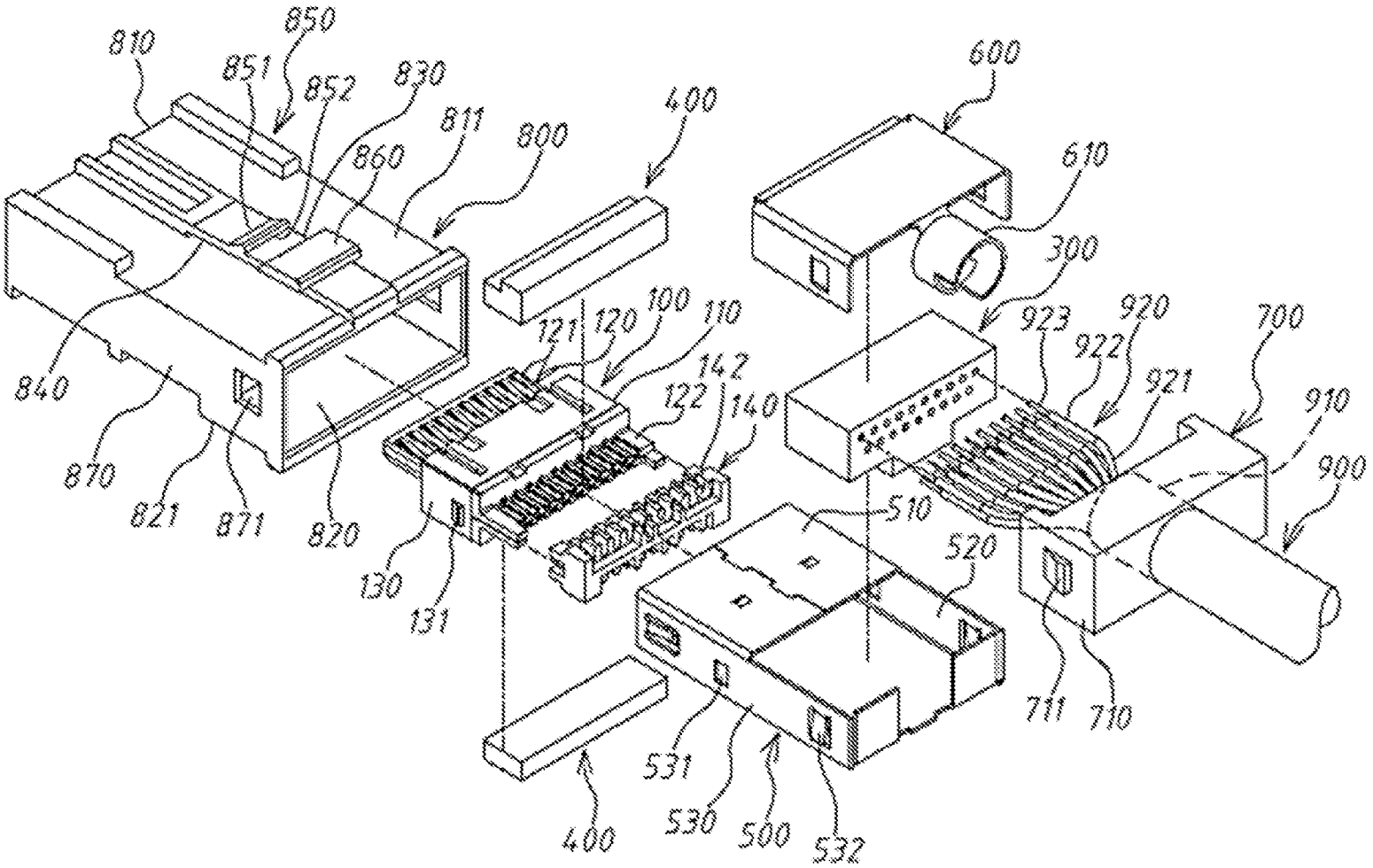
FIG. 8 is an exploded view depicting the wire-side connector shown in FIG. 1.

Referring to FIG. 12, the first internal mold compound 300 encloses the rear section 921 of each discrete core wire 920 of the cable wire 900 by a molding process, so that the geometry, the relative distance and position, and the dimension of each discrete core wire 920 are fixed. Similarly, referring to FIG. 14, the second internal mold compound 400 encloses the front section 923 of each discrete core wire 920 and the wiring end 122 of each terminal 120 by a molding process. FIG. 8 shows that an entire second internal mold compound 400 is formed by molding top and bottom parts of the second internal mold compound 400. Accordingly, the geometry, the relative distance and position, and the dimension of each discrete core wire 920 are solidified and fixed again at the rear section 923. That is, for each discrete core wire 920 electrically connected with the transmission main body 100, the rear section 921 thereof is enclosed by the first internal mold compound 300 using a molding process, the middle section 922 thereof is fixed with the clamp cage 140, and the front section 923 thereof is enclosed by the second internal mold compound 400 using a molding process. This sandwich type of clamping, solidifying and fixing enables the geometry, the relative distance and position, and the dimension of the transmission main body 100 connected to each discrete core wire 920 to be kept at the state under an expected design, so as to maintain the due impedance match and enhance the stability of the signal transmission.

Figure 15:
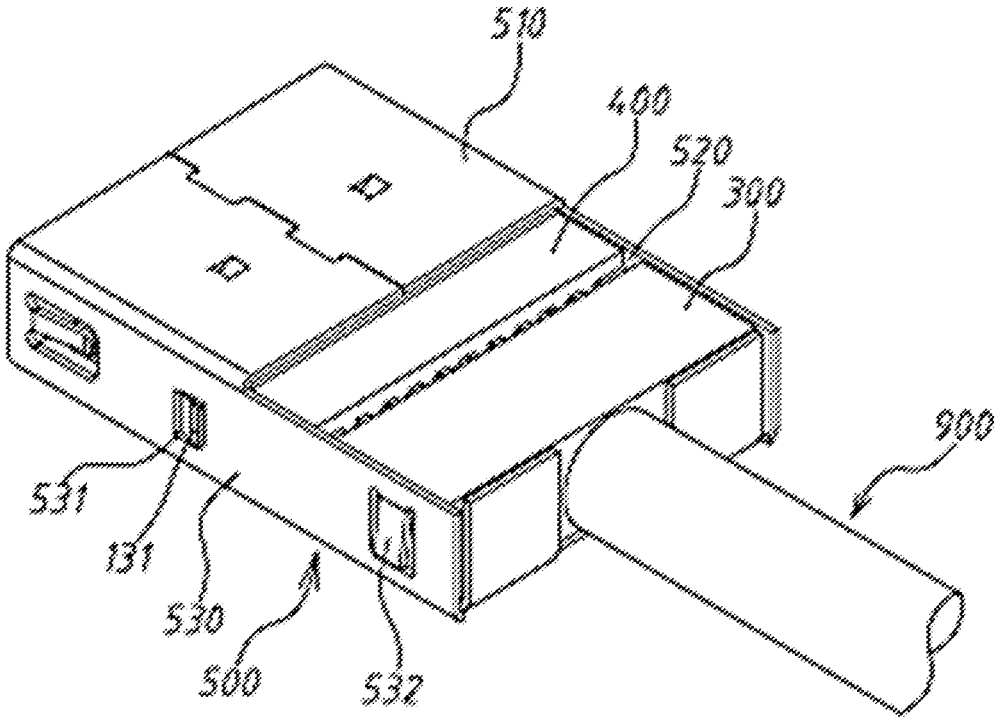
FIG. 15 depicts a schematic assembly view of assembling a metal bottom shell to the wire-side connector under the structure shown in FIG. 14.

Referring to FIG. 15, the metal bottom shell 500 is secured to the plastic frame 110 of the transmission main body 100, and carried at the bottom surfaces of the transmission main body 100, the clamp cage 140, the first internal mold compound 300, the second internal mold compound 400 and each of the discrete core wires 920. The top surface of the metal bottom shell 500 has a cover body 510 and an opening 520, wherein the cover body 510 covers the top surface of the transmission main body 100.

In one embodiment of fixing the metal bottom shell 500 to the plastic frame 110 of the transmission main body 100, each of two opposite sidewalls 530 of the metal bottom shell 500 is configured with a first buckle hole 531, and each of two opposite sidewalls 130 of the plastic frame 110 of the transmission main body 100 is configured with a first buckle body 131, which is buckled to the first buckle hole 531 of the metal bottom shell 500. As such, the assembly of the metal bottom shell 500 and the transmission main body 100 is achieved, and the metal bottom shell 500 covers the exterior of the plastic frame 110 of the transmission main body 100.

Figure 16:
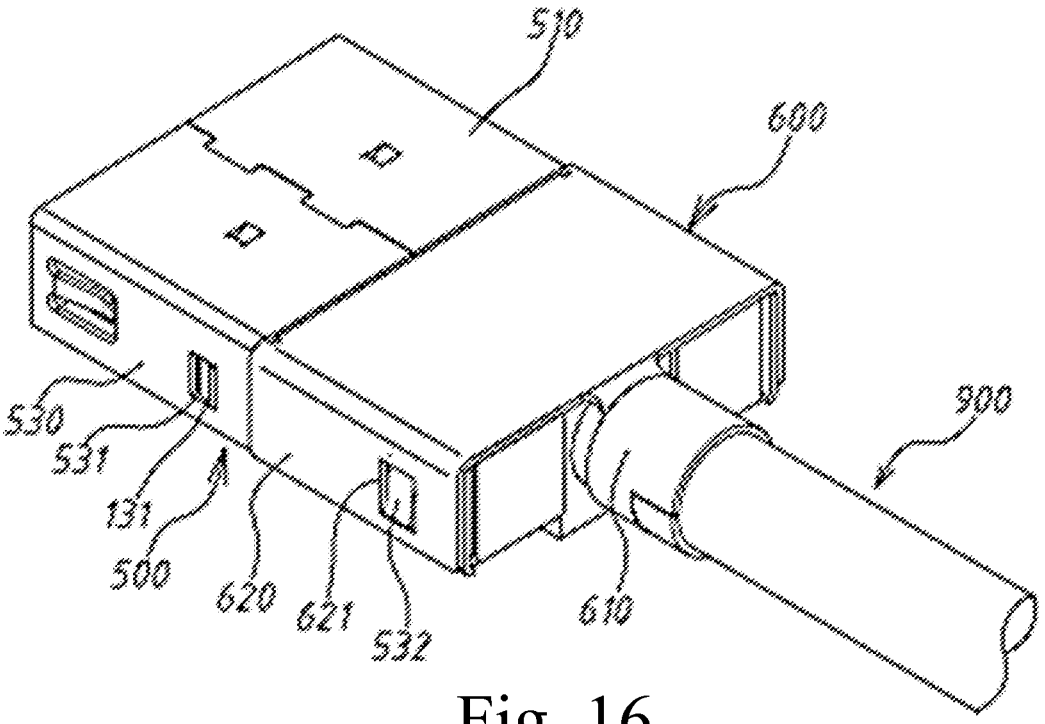
FIG. 16 depicts a schematic assembly view of assembling a metal top shell to the wire-side connector under the structure shown in FIG. 15.

Referring to FIG. 16, the metal top shell 600 covers the opening 520 of the metal bottom shell 500, and the metal top shell 600 has a fixing ring 610 for clamping the periphery of a jacket of the cable wire 900 at the end portion 910 of the cable wire 900, so as to stabilize the end portion of the cable wire 900.

In one embodiment of covering the metal top shell 600 to the opening 520 of the metal bottom shell 500, each of two opposite sidewalls 620 of the metal top shell 600 is configured with a second buckle hole 621, and each of two opposite sidewalls 530 of the metal bottom shell 500 is configured with a second buckle body 532, which is buckled to the second buckle hole 621 of the metal top shell 600. As such, the metal top shell 600 is secured to the metal bottom shell 500 through covering, and the metal top shell 600 covers the top surfaces of the clamp cage 140, the first internal mold compound 300 and the second internal mold compound 400. Furthermore, the metal shell body formed by the metal bottom shell 500 and the metal top shell 600 has an electric shielding effect for the transmission main body 100; and that is, the metal bottom shell 500 and the metal top shell 600 can insulate the electromagnetic wave of the loop of the transmission main body 100 from mutually interfering with the electromagnetic wave outside the electric shielding.

Figure 17:
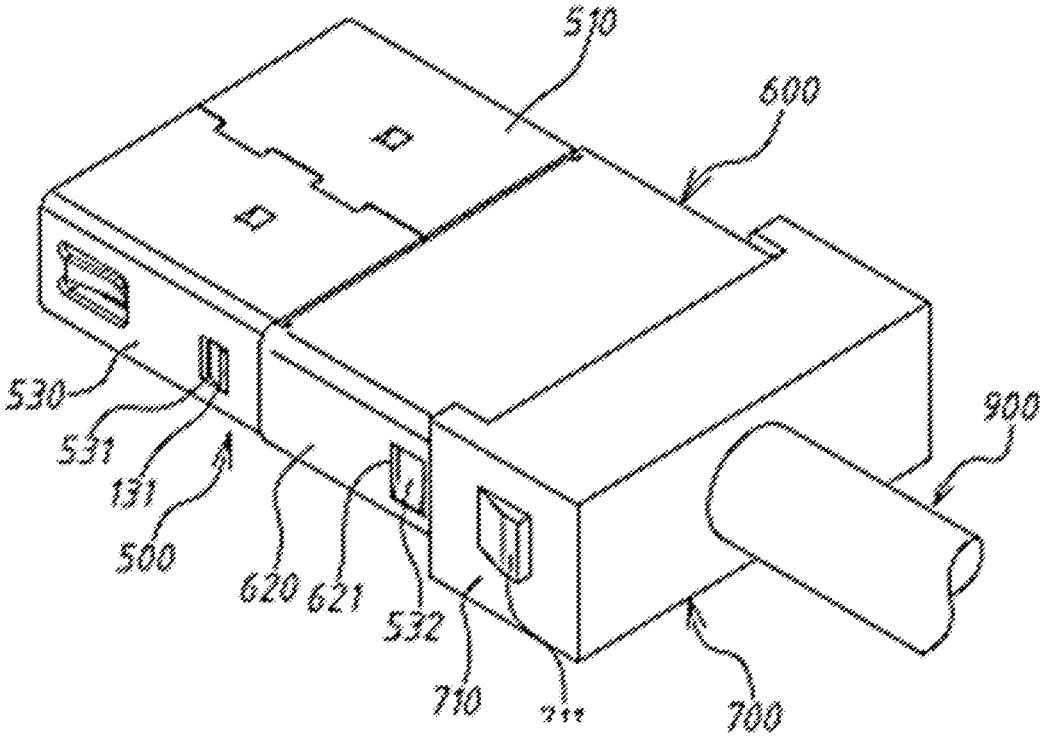
FIG. 17 depicts a schematic assembly view of assembling an external mold compound to the wire-side connector under the structure shown in FIG. 16.

Referring to FIG. 17, the external mold compound 700 encloses the periphery of a jacket of the cable wire 900 at the end portion 910 of the cable wire 900 by a molding process, and covers the fixing ring 610 of the metal top shell 600. The external mold compound 700 is formed by plastic injection molding, which is a soft external mold compound and has the function of absorbing the external force generated by twisting and bending the cable wire 900.

Figure 9:
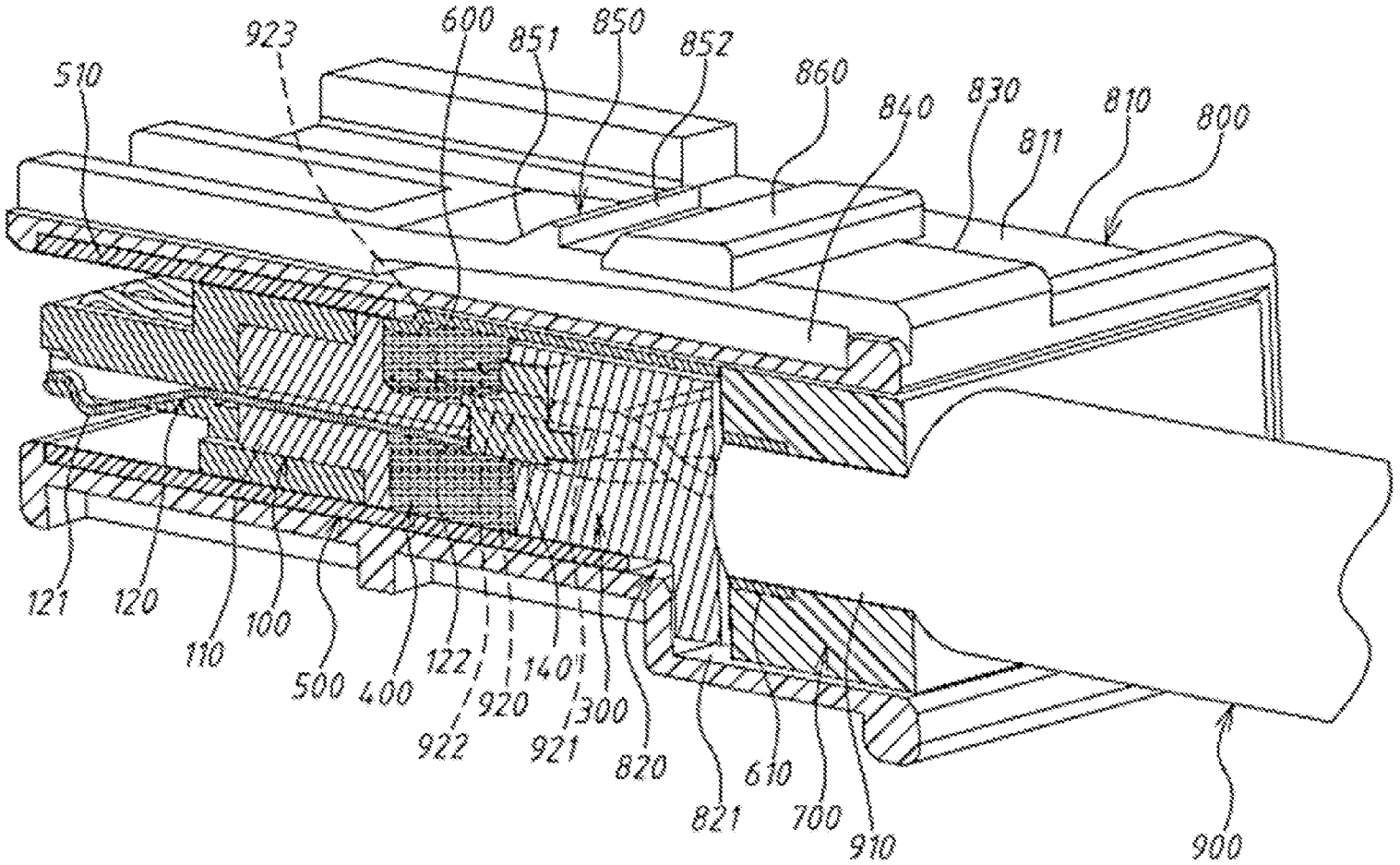
FIG. 9 depicts a sectional view of the wire-side connector taken along an A-A line shown in FIG. 7.
Figure 18:
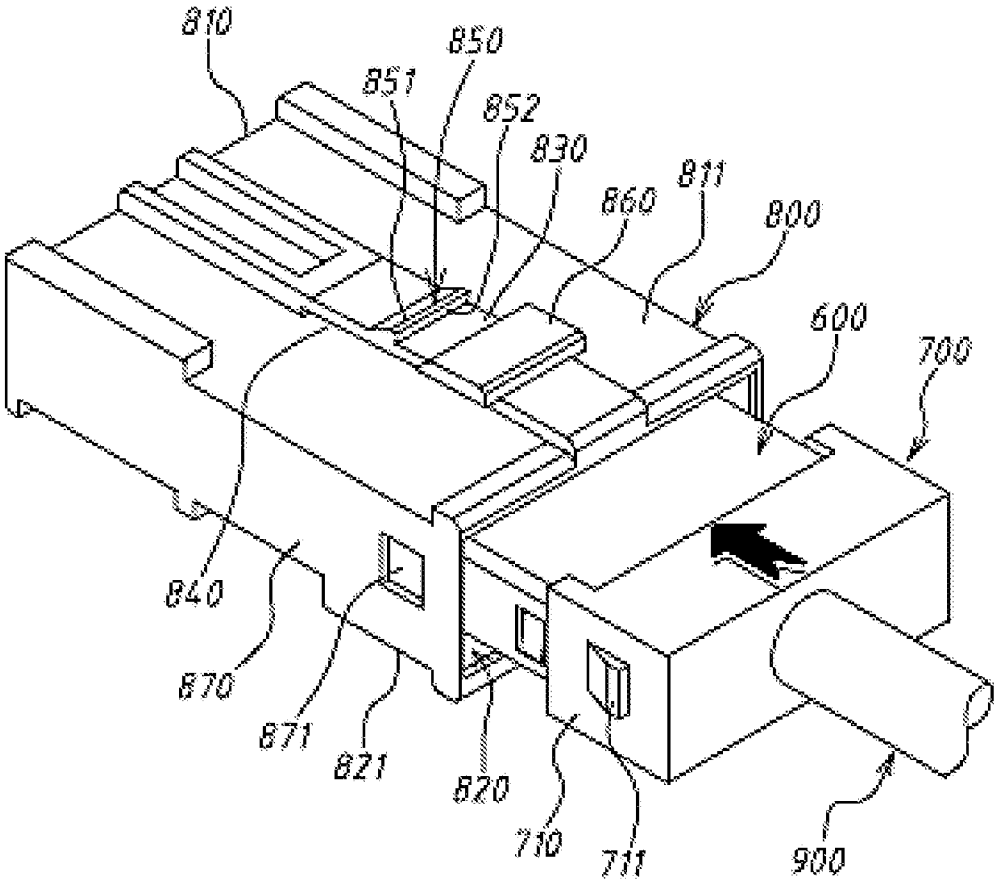
FIG. 18 depicts a schematic assembly view of assembling a plastic case to the wire-side connector under the structure shown in FIG. 17.

Referring to FIG. 18, a plastic case 800 is secured to the external mold compound 700. The plastic case 800 has a frame body 810 surrounding an accommodating chamber 820 for receiving the metal bottom shell 500, the metal top shell 600 and the external mold compound 700. Referring to FIG. 9, a concave-down part 821 is formed at the bottom surface of the rear end portion (i.e., a portion for receiving the external mold compound 700 and the end portion 910 of the cable wire 900) of the accommodating chamber 820. Accordingly, the external mold compound 700 and the first internal mold compound 300 have enough heights for fitting with the cable wire 900 with a larger diameter, and a height of the wire-side connector 20 plugged into the board-side connector 950 is maintained to be constant, so as to enhance the flexibility for a user selecting one of the cable wires with various diameters and achieve the breadth and convenience in use.

In one embodiment of fixing the plastic case 800 to the external mold compound 700, each of two opposite sidewalls 870 of the plastic case 800 is configured with a third buckle hole 871, and each of two opposite sidewalls 710 of the external mold compound 700 is configured with a third buckle body 711, which is buckled to the third buckle hole 871 of the plastic case 800. As such the plastic case 800 is fixed to the external mold compound 700.

Figure 10:
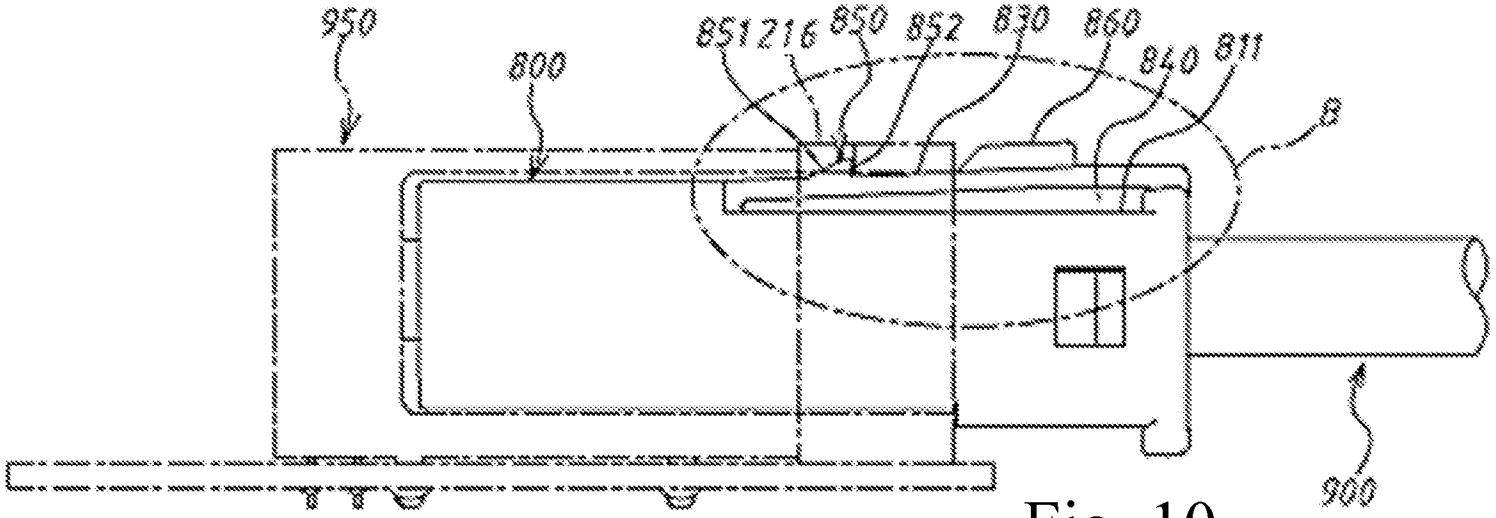
FIG. 10 is a side view depicting the wire-side connector shown in FIG. 7, and shows a schematic assembly view between the wire-side connector and a board-side connector.

Referring to FIGS. 10 and 18, the top surface 811 of the frame body 810 of the plastic case 800 is configured with a thin sheet 830 with the double supporting points, which means both ends of the thin sheet 830 is connected with the top surface 811 of the frame body 810, and a gap 840 exists between the middle of the thin sheet 830 and the top surface 811 of the frame body 810. As such the thin sheet 830 has elasticity, and the design that the both ends of the thin sheet 830 is connected with the double supporting points of the top surface 811 of the frame body 810, such that the thin sheet 830 is formed as a solid structural body with elasticity.

Figure 5:
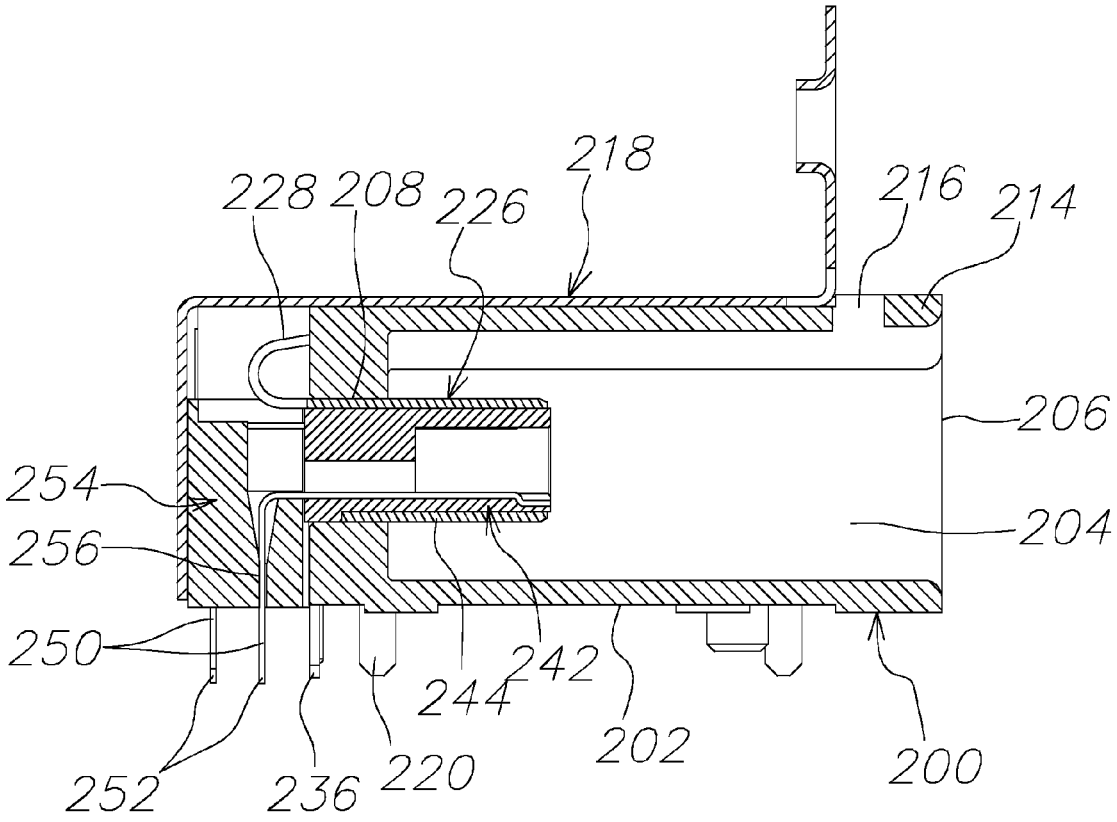
FIG. 5 depicts a sectional view of the board-side connector shown in FIG. 2.
Figure 6:
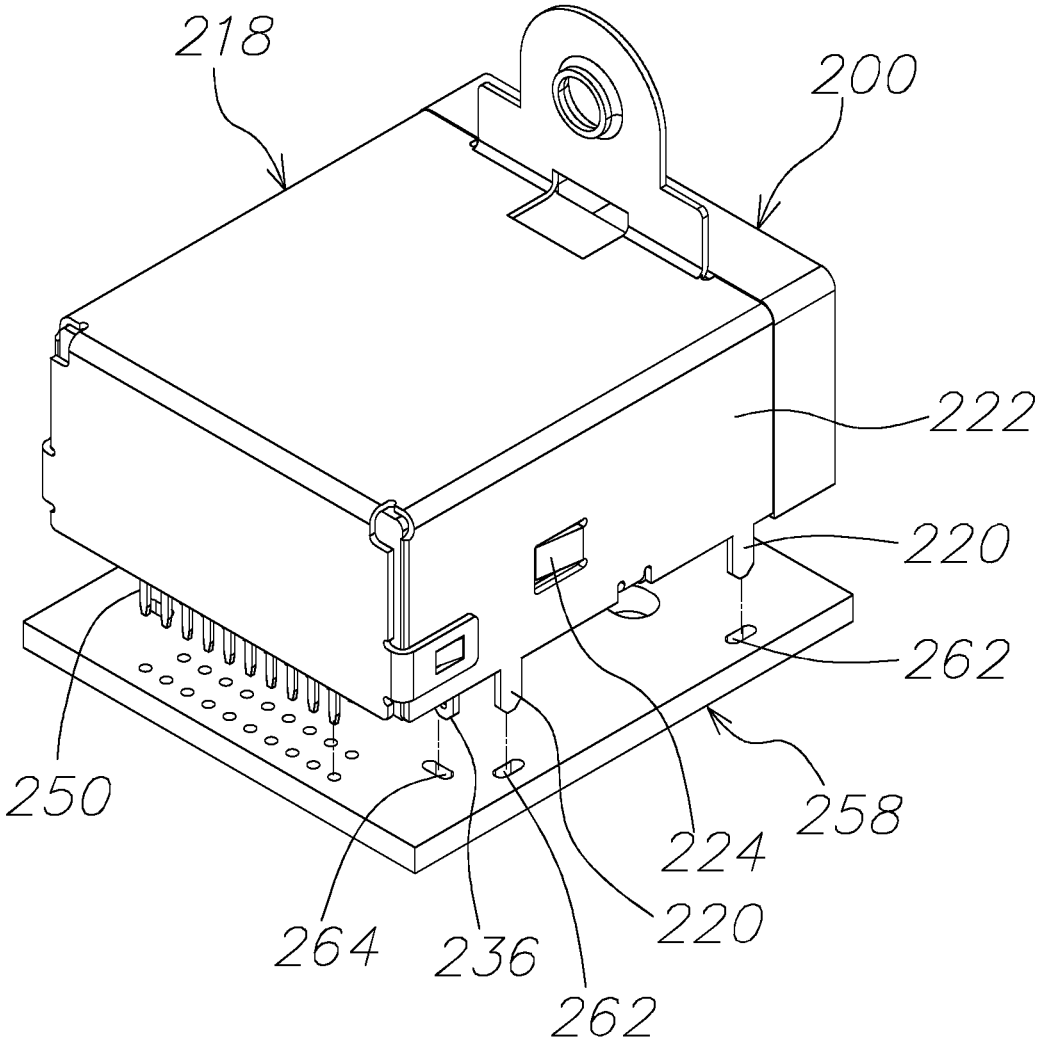
FIG. 6 depicts a schematic mounting view of mounting the board-side connector shown in FIG. 2 in a circuit board.
Figure 7:
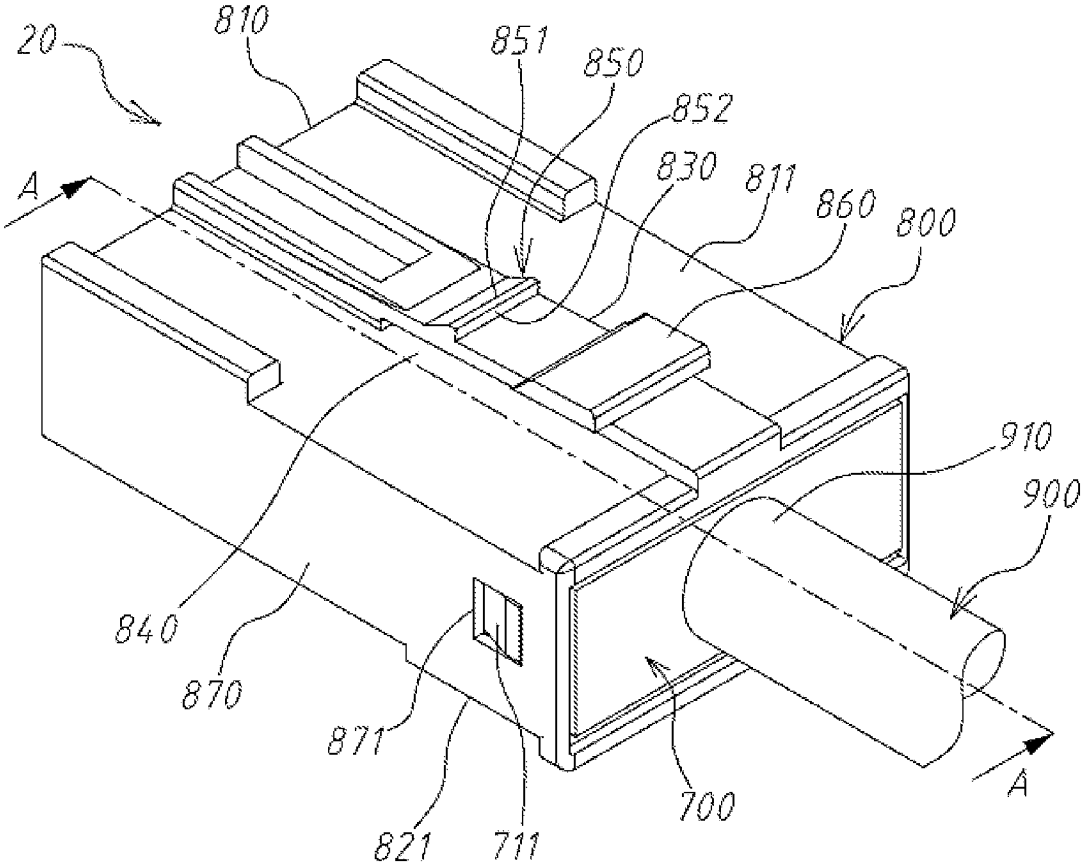
FIG. 7 is a perspective view depicting a wire-side connector according to an embodiment of the invention.

The top surface of the thin sheet 830 has a buckle body 850, which is a wedge-shaped buckle body. An inclined wall 851 and a vertical retaining wall 852 are respectively formed as the front end and the rear end of the buckle body. When the wire-side connector 20 is plugged into the board-side connector 950, the inclined wall 851 of the buckle body 850 can guide the buckle body 850 to be smoothly buckled to the buckle hole 216 of the board-side connector 950; and when the buckle body 850 and the buckle hole 216 are buckled and positioned, the vertical retaining wall 852 of the buckle body 850 can abut against the inner wall of the buckle hole 216 for preventing the attachment between them from getting loose. Further, when the wire-side connector 20 is plugged into the board-side connector 950, a front portion of the transmission main body 100 of the wire-side connector 20 can be plugged into the plastic frame 244 as seen in FIG. 5 such that the docking ends 121 of the terminals 120 at the front end of the transmission main body 100 of the wire-side connector 20 contact the terminals 250 in the transmission main body 242 of the board-side connector 950. The buckle body 850 is carried on the top surface of the thin sheet 830. Therefore, the buckle body 850 has elasticity due to the thin sheet 830, and when plugged into the board-side connector 950, the buckle body 850 and the buckle hole 216 provide a stable buckling force due to the double supporting points design of the thin sheet 830. Furthermore, in the process that the buckle body 850 is buckled to the buckle hole 216, the buckle body 850 and the thin sheet 830 release the existing elastic energy due to the deformation and issue a buckle crackle with a "click" sound along with the buckle hole 216. A resonance speaker box effect is formed when the buckle crackle sound passes through a gap 840 below the thin sheet 830, and the buckle crackle can be resonantly amplified, which has a good use effect and provides an authenticity of blind mating for the user.

Figure 11:
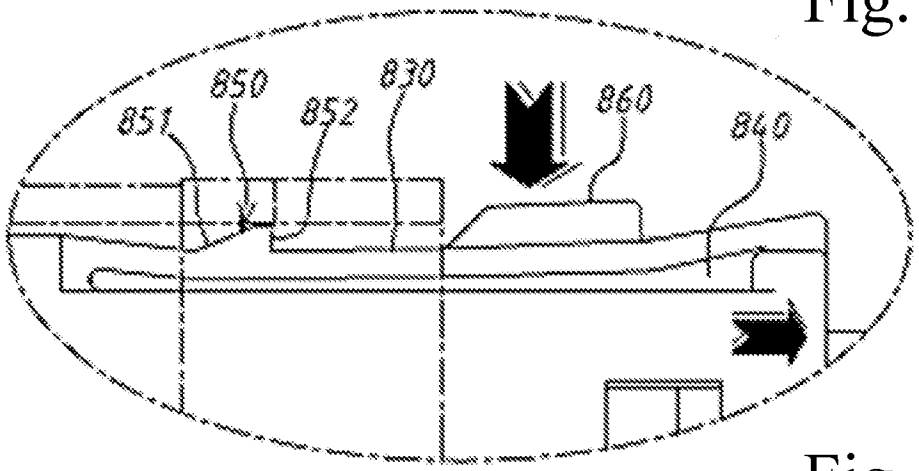
FIG. 11 depicts an enlarged view of the part B of the wire-side connector shown in FIG. 10 and shows the state when a press protrusion part is pressed down.

Referring to FIG. 11, the top surface of the thin sheet 830 is configured with a press protrusion body 860 at the rear position of the buckle body 850. When the press protrusion body 860 is pressed down by a user, the buckle body 850 can be consubstantially driven to sink, which makes the buckle body 850 depart from the constraint of the buckle hole 216 of the board-side connector 950, so that the wire-side connector 20 can be smoothly exited from the buckle hole 216, to provide the operation convenience for the user in extracting the wire-side connector 20.

The plastic case 800 is formed by plastic injection molding, which is the hard plastic case for buckling and positioning when plugged into the board-side connector 950. After the hard plastic case 800 is fixed to the above-described soft external mold compound 700, a structure with a front rigid body and a rear elastic body is formed, which has double effects. That is, the positioning crackle sound is generated at the moment that the plastic case 800 as the front rigid body is inserted to the board-side connector 950, which meets the authenticity of blind mating; and the external mold compound 700 as the elastic body covers at the end portion of the cable wire 900 and can absorb the external force generated by bending and twisting of the cable wire, such that the cable wire 900 can be winded adjacent to the wire-side connector 20, so as to increase the winding curvature of the cable wire, save the mounting space thereof and enhance the convenience of use.

For the wire-side connector 20 according to an embodiment of the invention, the thin sheet with the double supporting points structure and the buckle body can strengthen the mechanical strength of these members and provide the stable buckling force; furthermore, the configuration of the clamp cage, the first internal mold compound and the second internal mold compound keeps the geometry, the relative distance and position, and the dimension of each discrete core wire of the cable wire in the stable state to enhance the stability of the signal transmission; moreover, the design of the concave-down part of the accommodating chamber can extend the partial heights of the external mold compound and the first internal mold compound, and receive the cable wires with different wire diameters, so as to enhance the selecting flexibility for the cable wires with different wire diameters; and besides, the design of the plastic case and the external mold compound and the front rigid body and the rear elastic body thereof enables the external mold compound as the elastic body to absorb the external force generated by bending and twisting of the cable wire, such that the cable wire may be winded adjacent to the wire-side connector 20, so as to increase the winding curvature of the cable wire, save the mounting space thereof and enhance the convenience of use. The above descriptions actually reach the creative purposes of the invention.

The above connecting structure in accordance with the invention can be used for transferring data. For example, the connecting structure can be a high definition multimedia interface (HDMI) connector structure that can be used in a car, home or office, a mini HDMI connecting structure, a network cable connecting structure, a universal serial bus (USB) connecting structure, a mini USB connecting structure, a serial advanced technology attachment (SATA) connecting structure or an external serial advanced technology attachment (eSATA) connecting structure.

Although the invention has been described in detail with the above embodiments, the above description is only illustration of the invention, and is not used for limiting the implementing scope of the invention. Namely, simple equivalent variations and modifications made generally according to the claims and the description of the invention all fall within the scope of the invention.

What is claimed is:

1. A board-side connector for plugging with a wire-side connector, comprising:

a frame pedestal surrounding an accommodating chamber, wherein an opening is at a front end of the accommodating chamber and a mounting hole is at a rear end of the accommodating chamber, wherein the accommodating chamber is configured for accommodating the wire-side connector from the opening;

a metal outer shell covering the exterior of the frame pedestal;

a metal inner shell mounted to the mounting hole, wherein the metal inner shell protrudes into the accommodating chamber, wherein the metal inner shell comprises an elastic contacting arm contacting the metal outer shell; and a transmission main body mounted to an interior of the metal inner shell, wherein the transmission main body has a terminal having a first portion extending in the metal inner shell and accommodating chamber for contacting a terminal of the wire-side connector and a second portion extending outside the metal inner shell and accommodating chamber for connection to a circuit board.

2. The board-side connector of claim 1 further comprising a retainer at a rear end of the frame pedestal and in the metal outer shell, wherein an inserting hole in the retainer receives the second portion of the terminal.

3. The board-side connector of claim 1, wherein the metal outer shell comprises a welding foot configured to be bonded with the circuit board.

4. The board-side connector of claim 1, wherein the metal inner shell comprises a welding foot configured to be bonded with the circuit board.

5. The board-side connector of claim 1, wherein a positioning hole is at a front end of the frame pedestal, wherein the positioning hole is configured to receive a buckle of the wire-side connector.

6. The board-side connector of claim 1, wherein a groove in the elastic contacting arm extends along a longitudinal direction of the elastic contacting arm.

7. The board-side connector of claim 1, wherein the metal outer shell comprises a first welding foot configured to be bonded with the circuit board and the metal inner shell comprises a second welding foot configured to be bonded with the circuit board, wherein the first welding foot has a width perpendicular to a width of the second welding foot.

8. The board-side connector of claim 1, wherein the frame pedestal comprises a recessed portion receiving a buckle of the metal outer shell.

9. The board-side connector of claim 1, wherein the transmission main body comprises a recessed portion receiving a buckle of the metal inner shell.

10. A wire-side connector mounted to an end of a cable wire and configured for plugging with a board-side connector, wherein the cable wire has multiple discrete core wires, comprising:

a transmission main body having multiple terminals having multiple first ends soldered to the discrete core wires and multiple second ends configured to contact terminals of the board-side connector;

a clamp cage at a rear side of the transmission main body, wherein multiple clamp slots at the clamp cage clamp the discrete core wires; and a plastic case surrounding an accommodating chamber, wherein the accommodating chamber receives the second ends of the terminals, wherein the plastic case comprises a thin sheet with two supporting points at two opposite ends of the thin sheet, wherein a gap is under the thin sheet and between the supporting points, and a first buckle at a top surface of the thin sheet, wherein the first buckle is configured to be received in a positioning hole at the board-side connector.

11. The wire-side connector of claim 10, wherein the first buckle has an inclined wall at a front side of the first buckle and a vertical wall at a rear side of the first buckle.

12. The wire-side connector of claim 10, wherein the plastic case comprises a protrusion body at a top surface of the thin sheet and at a rear side of the first buckle, wherein the protrusion body is configured to be pressed down by a user.

13. The wire-side connector of claim 10 further comprising an internal mold compound at a front side of the clamp cage, wherein the internal mold compound encloses the discrete core wires soldered to the first ends of the terminals.

14. The wire-side connector of claim 10 further comprising an internal mold compound at a rear side of the clamp cage, wherein the internal mold compound encloses the discrete core wires.

15. The wire-side connector of claim 10 further comprising a metal shell secured to the transmission main body, wherein the metal shell surrounds the transmission main body.

16. The wire-side connector of claim 11 further comprising an external mold compound at a rear end of the wire-side connector, wherein the external mold compound encloses a jacket of the cable wire.

17. The wire-side connector of claim 16, wherein a hole at the plastic case receives a second buckle of the external mold compound.

18. The wire-side connector of claim 16 further comprising a metal ring clamping a jacket of the cable wire, wherein the external mold compound further encloses the metal ring.

19. The wire-side connector of claim 10 further comprising an external mold compound at a rear end of the wire-side connector, wherein the external mold compound encloses a jacket of the cable wire, and an internal mold compound at a front side of the clamp cage, wherein the internal mold compound encloses the discrete core wires soldered to the first ends of the terminals, wherein the external mold compound is softer than the internal mold compound.

20. A board-side connector for plugging with a wire-side connector, comprising:

a frame pedestal surrounding an accommodating chamber, wherein an opening is at a front end of the accommodating chamber and a mounting hole is at a rear end of the accommodating chamber, wherein the accommodating chamber is configured for accommodating the wire-side connector from the opening;

a metal outer shell covering the exterior of the frame pedestal;

a metal inner shell mounted to the mounting hole, wherein the metal inner shell protrudes into the accommodating chamber, wherein the metal inner shell comprises a first welding foot configured to be bonded with a circuit board; and a transmission main body mounted to an interior of the metal inner shell, wherein the transmission main body has a terminal having a first portion extending in the metal inner shell and accommodating chamber for contacting a terminal of the wire-side connector and a second portion extending outside the metal inner shell and accommodating chamber for connection to the circuit board.

21. The board-side connector of claim 20 further comprising a retainer at a rear end of the frame pedestal and in the metal outer shell, wherein an inserting hole in the retainer receives the second portion of the terminal.

22. The board-side connector of claim 20, wherein the metal outer shell comprises a second welding foot configured to be bonded with the circuit board.

23. The board-side connector of claim 22, wherein the first welding foot has a width perpendicular to a width of the second welding foot.

24. The board-side connector of claim 20, wherein a positioning hole is at a front end of the frame pedestal, wherein the positioning hole is configured to receive a buckle of the wire-side connector.

25. The board-side connector of claim 20, wherein the frame pedestal comprises a recessed portion receiving a buckle of the metal outer shell.

26. The board-side connector of claim 20, wherein the transmission main body comprises a recessed portion receiving a buckle of the metal inner shell.

* * * * *